US008036413B2

(12) United States Patent
Kim

(10) Patent No.: US 8,036,413 B2
(45) Date of Patent: Oct. 11, 2011

(54) REMOTE CONTROLLER HAVING ECHO FUNCTION

(76) Inventor: Bong Suk Kim, Chungju (KR)

( * ) Notice: Subject to any disclaimer, the term of this patent is extended or adjusted under 35 U.S.C. 154(b) by 1019 days.

(21) Appl. No.: 11/912,761

(22) PCT Filed: Apr. 24, 2006

(86) PCT No.: PCT/KR2006/001531

§ 371 (c)(1),
(2), (4) Date: Oct. 26, 2007

(87) PCT Pub. No.: WO2006/115359

PCT Pub. Date: Nov. 2, 2006

(65) Prior Publication Data

US 2008/0187160 A1 Aug. 7, 2008

(30) Foreign Application Priority Data

Apr. 27, 2005 (KR) ..... 10-2005-0035177

(51) Int. Cl.
*H04R 25/00* (2006.01)

(52) U.S. Cl. ..... 381/375; 381/374; 381/370

(58) Field of Classification Search ..... 381/370, 381/374–375

See application file for complete search history.

(56) References Cited

U.S. PATENT DOCUMENTS

| | | | | | |
|---|---|---|---|---|---|
| 4,270,226 | A * | 5/1981 | Weintraub et al. | 455/353 |
| 5,542,000 | A * | 7/1996 | Semba | 381/61 |
| 5,569,869 | A * | 10/1996 | Sone | 84/609 |
| 5,598,162 | A * | 1/1997 | Terashima et al. | 341/176 |
| 5,993,220 | A * | 11/1999 | Nakamura et al. | 434/307 A |
| 6,147,291 | A * | 11/2000 | Matsumoto | 84/611 |
| 6,748,095 | B1 * | 6/2004 | Goss | 381/374 |
| 7,262,358 | B2 * | 8/2007 | Lubbers | 84/625 |
| 7,277,551 | B2 * | 10/2007 | Miura et al. | 381/98 |
| 7,912,211 | B1 * | 3/2011 | Lambert | 379/406.08 |
| 2003/0033152 | A1 | 2/2003 | Cameron | |
| 2003/0190047 | A1 | 10/2003 | Aarts | |
| 2005/0213747 | A1 * | 9/2005 | Popovich et al. | 379/406.03 |
| 2006/0182291 | A1 * | 8/2006 | Kunieda et al. | 381/110 |
| 2006/0228684 | A1 * | 10/2006 | Yoon | 434/307 A |
| 2008/0162120 | A1 * | 7/2008 | Mactavish et al. | 704/201 |
| 2008/0187160 | A1 * | 8/2008 | Kim | 381/375 |
| 2009/0010445 | A1 * | 1/2009 | Matsuo | 381/66 |
| 2010/0203491 | A1 * | 8/2010 | Yoon | 434/307 A |

FOREIGN PATENT DOCUMENTS

| | | | |
|---|---|---|---|
| JP | 08140157 | A * | 5/1996 |
| JP | 2004-046959 | A | 2/2004 |
| JP | 2004-153360 | A | 5/2004 |
| JP | 2004-233793 | A | 8/2004 |
| KP | 2004-012115 | A | 2/2004 |

* cited by examiner

*Primary Examiner* — Laura Menz

(74) *Attorney, Agent, or Firm* — Park & Associate IP Law, P.C.

(57) ABSTRACT

A remote controller having an echo function is disclosed, which comprises an echo circuit which includes an echo IC and an echo volume switch, with the echo IC being designed to amplify and circulate voice signals for generating echo, and with the echo circuit being connected with the microphone driving unit, the voice amplifier and the mixer circuit, respectively. In the remote controller, a user's voice and an external sound from an audio apparatus are outputted based on an echo effect when a user practices language or singing.

4 Claims, 4 Drawing Sheets

[Fig. 1]
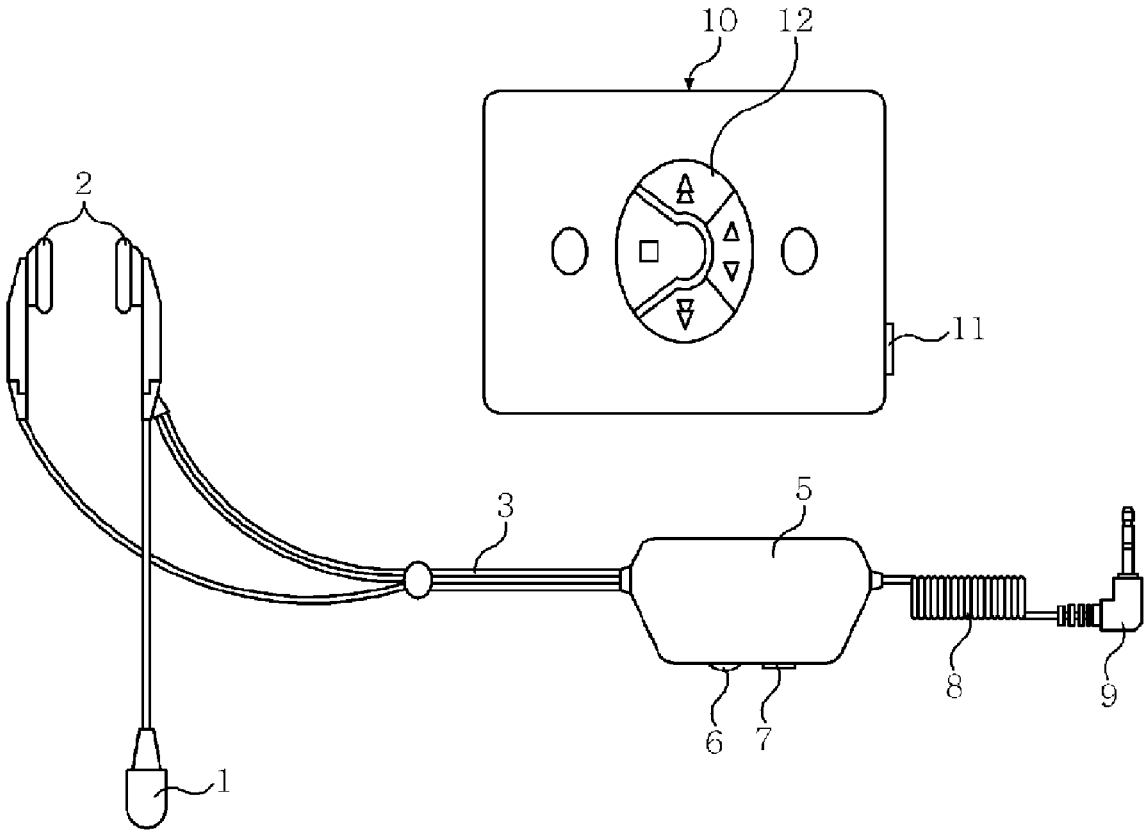

[Fig. 2]
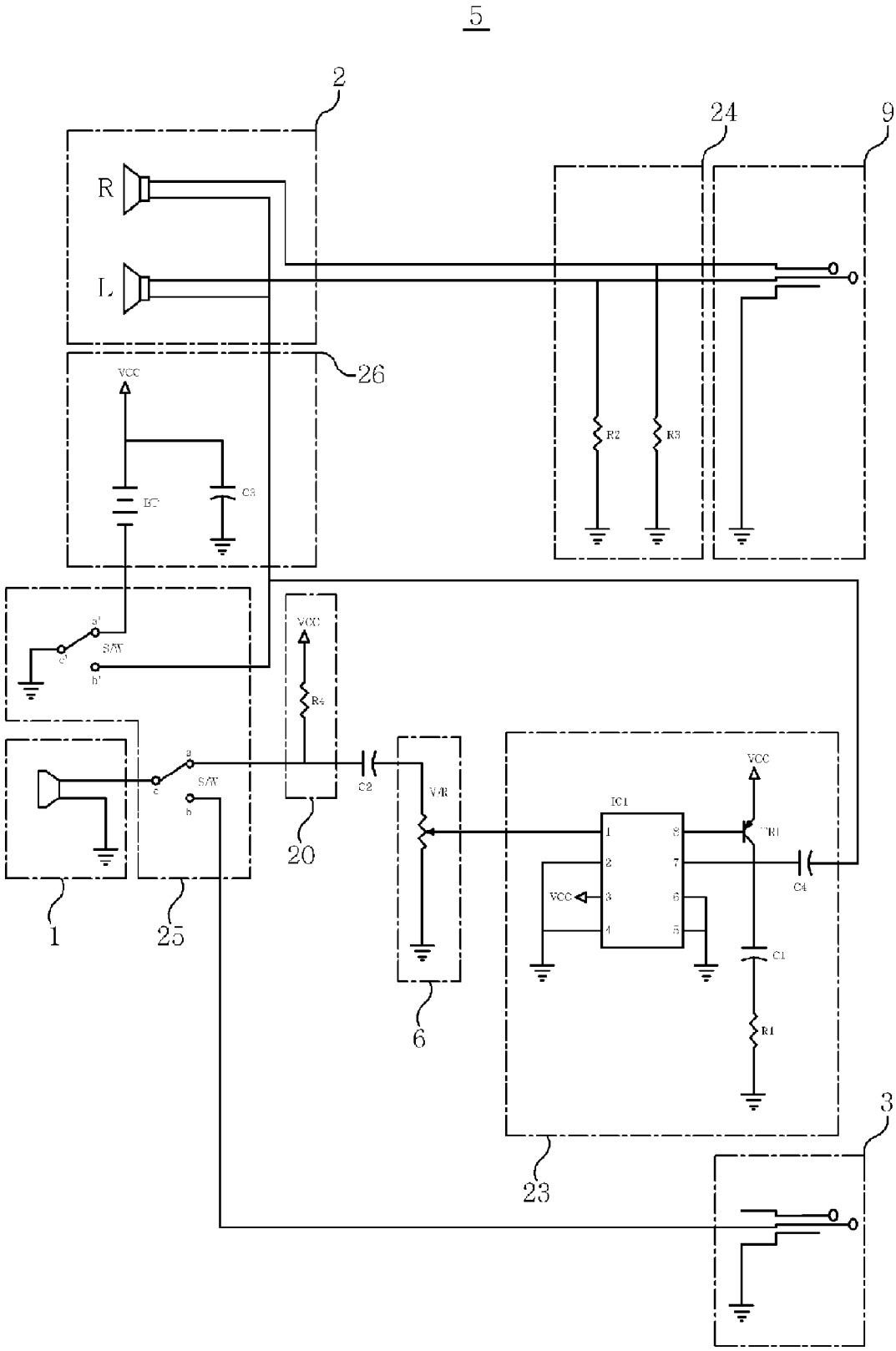

[Fig. 3]
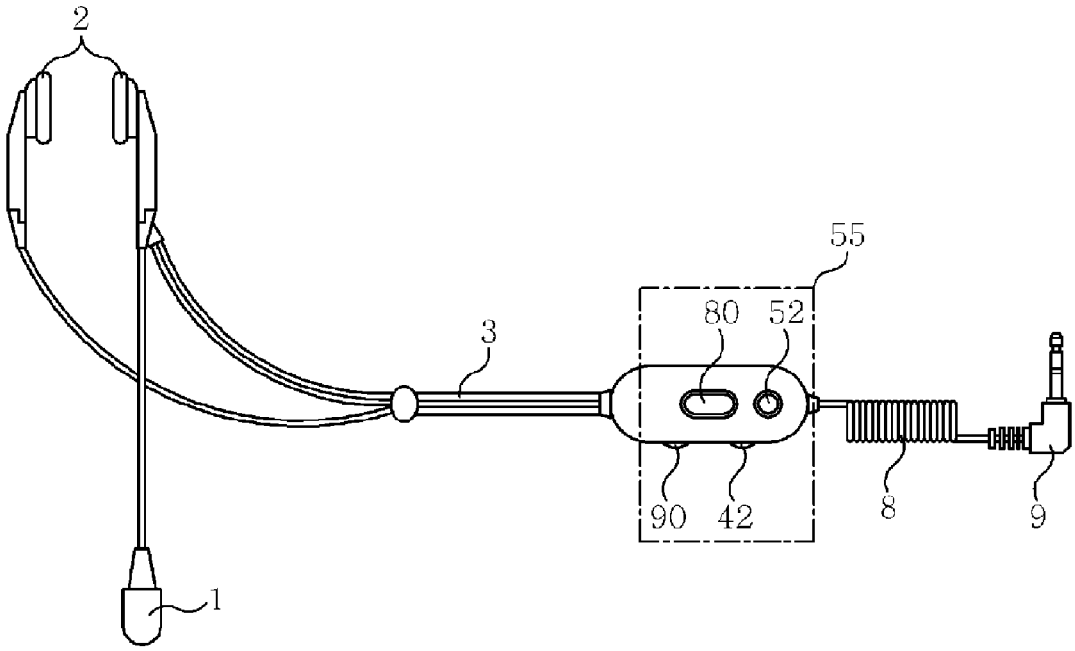

[Fig. 4]
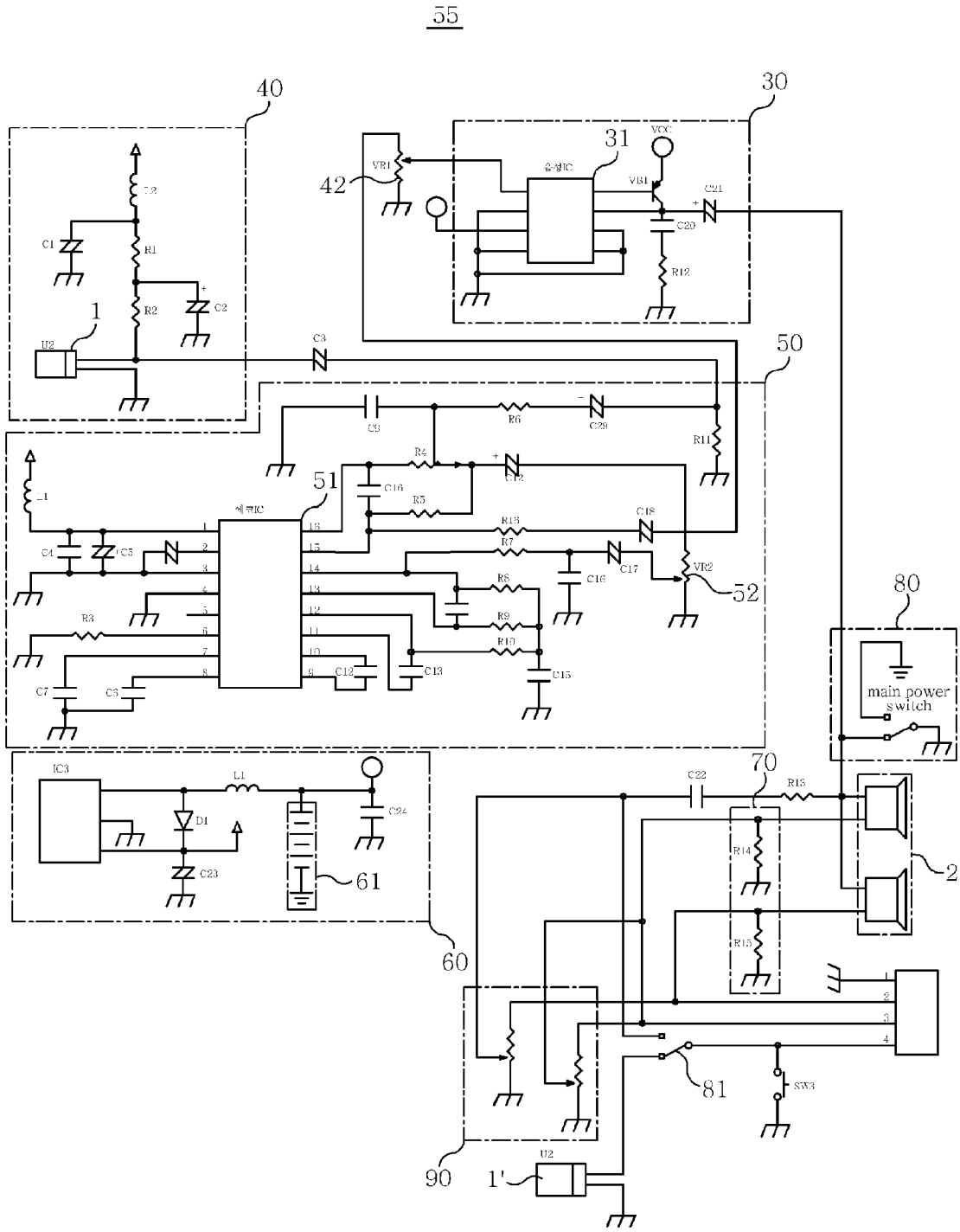

REMOTE CONTROLLER HAVING ECHO FUNCTION

TECHNICAL FIELD

The present invention relates to a remote controller having an echo function, and in particular to a remote controller having an echo function in which a user's voice from a microphone and an external sound from an audio apparatus can be outputted with an echo effect by providing a remote controller for an audio apparatus with an echo function.

BACKGROUND ART

In the following descriptions, the term "audio apparatus" represents a cassette tape recorder, a MP3, a CD player, a cellular phone, a PDA, a DMB, etc. According to the Korean patent application "wired remote controller for audio apparatus" laid-open number 0092121 (laid-open date: Oct. 24, 2001) which is adapted as a prior art of the present invention, a user voice from a microphone and an external sound from an audio apparatus are selectively outputted through a speaker of an ear phone, so that a language practice function and a song practice function are obtained.

FIG. 1 is a perspective view illustrating an earphone of an audio apparatus of the Korean patent number 0346314, and FIG. 2 is a circuit diagram of an electric construction of FIG. 1.

As shown in FIG. 1, an audio apparatus earphone unit comprises an earphone 3 having a microphone 1 and a speaker, a remote controller and a connection part 8 which connects an audio apparatus 10 including a cassette tape recorder and a remote controller 5. In the drawings, reference numeral 11 represents an input plug of an earphone and a microphone connected with the audio apparatus 10, and 12 represents a switch for operating and adjusting the audio apparatus 10.

Here, the remote controller 5 controls the operation of the audio apparatus 10 and adjusts the sound inputted into the audio apparatus 10 for thereby preventing any interference between the sound from the audio apparatus 10 and the user's voice inputted from the microphone 1.

As shown in FIG. 2, in the interior of the remote controller 5, a microphone volume switch 6 is connected at an output side of a microphone driving unit 20 which is adapted to driving the microphone 1, with the microphone volume switch 6 being designed to adjust the sound from the microphone 1, and with a variable resistor (VR) being provided in the microphone 1.

A voice input amplifier 23 is connected at an output side of the microphone volume switch 6, with the voice input amplifier 23 being formed of a voice chip IC capable of amplifying the voice signal inputted from the microphone 1. An output selection switch 25 is connected at an output side of the audio input amplifier 23 for selectively outputting a user's voice inputted from the microphone 1 and an output of the audio apparatus 10 inputted from the input plug 9 which connects the audio apparatus 10 and the remote controller 5.

A voice mixer 24 is connected between the input plug 9 and the speaker 2, with the input plug 9 being adapted to connect the audio apparatus 10 and the remote controller 5, for thereby outputting a user's voice from the microphone 1 and an output of the audio apparatus 10 to the speaker 2 through different paths, with the voice mixer 24 being formed of impedance matching resistors R2 and R3 of the speaker 2 for connecting an output of the audio apparatus 10 to the ground so as to prevent sound interference.

There is further provided a power unit 26 for supplying power to the speaker 2 in accordance with an operation of the output selection switch 25.

In the conventional art, while directly hearing the sound from the audio apparatus, the user can practice language or singing. However, the conventional art is not provided with an echo function when a user hears, so that it is impossible to achieve more effective sound effects.

DISCLOSURE OF INVENTION

Technical Problem

Accordingly, it is an object of the present invention to provide a remote controller having an echo function in which a user's voice and an external sound from an audio apparatus are outputted based on an echo effect when a user practices language or singing.

Technical Solution

To achieve the above objects, in a remote controller for an audio apparatus which comprises a microphone driving unit which operates in accordance with an operation of a main power switch and drives a microphone which receives a user's voice; a microphone volume switch which is connected with an output side of the microphone driving unit for adjusting sound inputted from the microphone; an input voice amplifier which is connected with an output side of the microphone volume switch and has a voice IC for amplifying a voice signal inputted from the microphone; a music volume switch which adjusts an output sound inputted through an input plug of the audio apparatus connected with an output side of the input voice amplifier; a voice mixer which includes two resistors R2 and R3 between the input plug and the speaker and allows an output sound of the audio apparatus to impedance-match with respect to the speaker and outputs a voice signal inputted through the microphone and an output sound of the audio apparatus through different paths; and a power amplifier which amplifies current supplied from the power unit in accordance with an operation of the main power switch, there is provided a remote controller having an echo function which comprises an echo circuit which includes an echo IC and an echo volume switch, with the echo IC being designed to amplify and circulate voice signals for generating echo, and with the echo circuit being connected with the microphone driving unit, the voice amplifier and the mixer circuit, respectively.

The remote controller of the present invention may be provided in the interior of an earphone or a head set and may be provided in the interior of a remote controller connected with an earphone or a head set. The remote controller may be provided in an interior of an intermediate or large size head set.

The remote controller is provided in at least one among a CD player, a MP3, a cellular phone, a DMB, and the like.

Advantageous Effects

In the present invention, a user's voice and an external sound from an audio apparatus can be outputted based on an echo effect when a user practices language or singing, so that it is possible to practice singing like a singing practice room, anytime. In addition, since an echo function is provided when a user practices language, it is possible to perform a language practice in a more actual situation.

In addition, a user can sing pop songs while hearing a corresponding pop song through ears based on an echo effect, so that the user can practice pronunciation of a corresponding language like native speakers.

BRIEF DESCRIPTION OF THE DRAWINGS

FIG. 1 is a perspective view illustrating a conventional earphone for an audio apparatus;

FIG. 2 is a circuit diagram of an electric construction of an example of FIG. 1;

FIG. 3 is a perspective view illustrating a remote controller having an echo function according to the present invention; and FIG. 4 is a circuit diagram of an electric construction according to a preferred embodiment of the present invention.

BEST MODE FOR CARRYING OUT THE INVENTION

The preferred embodiments of the present invention will be described in detail with reference to the accompanying drawings.

FIG. 3 is a perspective view illustrating a remote controller having an echo function according to the present invention, and FIG. 4 is a circuit diagram of an electric construction according to a preferred embodiment of the present invention.

Similarly with the conventional construction shown in FIG. 1, the earphone unit for an audio apparatus comprises an earphone 3 formed of a microphone 1 and a speaker 2, an audio apparatus 10 like a cassette tape recorder, a remote controller 5 which controls an operation of the audio apparatus 3 and adjusts sound inputted into the audio apparatus 10 for thereby preventing interference an output of the audio apparatus 10 and a user's voice inputted from the microphone 1, a connection part 8 for connecting the remote controller 5 and the audio apparatus 10, an input plug 11 of the earphone and microphone connected with the audio apparatus 10, and an adjusting switch 12 which adjusts the volume of the audio apparatus.

As shown in FIG. 3, the remote controller 55 according to the present invention corresponds to a remote controller device which is constituted in such a manner that the remote controller 5 is further provided with a microphone volume switch 42 for adjusting the volume of the microphone 1, an echo volume switch 52 for adjusting the volume of the echo, a main power switch 80, and a music volume switch 90 for adjusting the volume of music, with the conventional audio apparatus 10 being basically provided with an echo function in the present invention.

When a user wants to practice singing, a user's voice and an external sound (music) inputted from the audio apparatus 10 such as a MP3, a cellular phone, etc. are inputted into the remote controller 55. When the user turns on the main power switch 80, the microphone 1 and the echo function are operated. When the power is not turned on, only the earphone function can be used. At this time, when the echo volume switch 52 is turned on, the echo circuit unit 50 of FIG. 4 operates, and an echo signal is inputted into the remote controller 55.

When the user adjusts the echo volume switch 52 and the music volume switch 90, it is possible to hear a desired volume of sounds. When the user sings a song while wearing a headphone or an earphone, it is possible to sing a song while hearing echo and music together by properly adjusting the microphone volume switch 42 and the music volume switch 90.

When the user wants to practice language, an external sound (foreign language) inputted from the audio apparatus 10 such as a cassette tape recorder, etc. is inputted into the remote controller 55, so that the user can hear the voice that the user pronounces by following the external sound.

When the user turns on the main power switch 80, the microphone 1 and the echo circuit unit 50 of FIG. 4 operate, and an echo signal is inputted into the remote controller 55. At this time, when the user adjusts the echo volume switch 52 and the microphone volume switch 42, the user can practice language while hearing the echo adjusted to a certain level. In particular, the user can pronounce like native speaker by just singing following the outputting pop song, so that it is possible to effectively practice the language.

During the practice of the language, since the user practices while wearing a head phone or an earphone, as shown in FIG. 3, it is preferred that the remote controller 55 is provided between the earphone 3 and the connection part 8.

FIG. 4 is a circuit diagram of an electric construction according to a preferred embodiment of the present invention. As shown in FIG. 4, in the electric circuit of the present invention, the circuit of the wired remote controller for an audio apparatus of FIG. 2 is provided with an echo circuit 50 together with a microphone driving unit 40, a voice amplifier 30, a speaker 2 and a mixing circuit 70, with the echo circuit 50 being designed to generate echo effects. With this construction, a user's echo voice and a sound of an external audio apparatus can be concurrently outputted.

As shown in FIG. 2, the conventional electric circuit of a wired remote controller for an audio apparatus comprises a microphone driving unit 20 for driving a microphone 1 which receives a user's voice; a microphone volume switch 6 which is connected with an output side of the microphone driving unit 20 for adjusting the sound inputted from the microphone 1; an input voice amplifier 23 which is connected with an output side of the microphone volume switch 6 and is formed of a voice IC for amplifying a voice signal inputted from the microphone 2; an output selection switch 25 which is connected with an output side of the input voice amplifier 23 for selectively outputting a user's voice from through the microphone 1 and an output of the audio apparatus inputted through an input plug 11; a voice mixer 24 which includes two resistors R2 and R3 between the input plug 11 and the speaker 2 and allows an output sound of the audio apparatus to impedance-match with respect to the speaker 2 and outputs a voice signal inputted through the microphone 1 and an output sound of the audio apparatus through different paths; and a power unit 26 for supplying power to the power amplifier 23 in accordance with an operation of the output selection switch 25.

As shown in FIG. 4, the electric circuit of the remote controller 55 according to the present invention comprises a microphone driving unit 40 which receives a user's voice and drives the microphone 1; a microphone volume switch 42 which is connected with an output side of the microphone driving unit 40 for adjusting sound inputted from the microphone 1; an input voice amplifier 30 which is connected with an output side of the microphone volume switch 42 and has a voice IC 31 for amplifying a voice signal inputted from the microphone 1; a main power switch 80 which is connected with an output side of the input voice amplifier 30 and selectively outputs a user's voice inputted through the microphone 1 and an output sound from the audio apparatus inputted through the input plug 11; and a voice mixer 70 which includes two resistors R2 and R3 between the input plug 11 and the speaker 2 and allows an output sound of the audio apparatus to impedance-match with respect to the speaker 2 and outputs a voice signal inputted through the microphone 1 and an output sound of the audio apparatus through different paths. The power unit 61 is further provided at the power amplifier 60 for supplying power to the power amplifier 60 in accordance with an operation of the main power switch 80. There is further provided an echo circuit 50 which is formed an echo IC 51 and an echo volume switch 52, with the echo IC 51 being designed to amplify about 80% of the total voice signals and feeding back the remaining 20% of the same so as to generate echo and converting an analog signal into a digital signal. Here, the echo circuit 50 is connected with the microphone driving unit 40. In the drawings, reference numeral 1 represents a hands-free microphone which operates by a mobile communication device and is used when echo is not used.

The power unit 61 provided in the interior of the power amplifier 60 is a 1.5V battery and the 1.5V current of the battery is amplified to 5V by the power amplifier 60.

The main power switch 80 further includes a switch 81 which operates for transferring a user's echo sound to a caller when a mobile communication device is used. The main power switch 80 and the switch 81 operate at the same time.

The echo IC 51 provided in the echo circuit 50 amplifies and circulates the voice signal and converts into digital signals for thereby automatically generating echo sounds.

The operation of the present invention will be described with reference to the accompanying drawings.

First, as shown in FIG. 3, when the remote controller 55 and the main power switch 80 are turned off, only an earphone function is used. When the main power switch 80 operates, a user's voice is inputted through the microphone 1, so that the user can hear his voice through the speaker 2. When a mobile communication device is used, an echo sound of the user is transferred to an opponent's device.

When a user wants to practice singing while hearing music, the main power switch 80 is operated, and the microphone volume switch 42 is properly adjusted for adjusting his voice volume. The music volume switch 90 is adjusted for hearing a certain volume music. The echo volume switch 52 can be also adjusted for a desired volume. With the above construction and operation, it is possible to hear his voice with echo effects.

As shown in FIG. 4, in a state that the echo volume switch 52 is operated, when the microphone 1 generates a voice signal based on the user's voice, the volume of the generated voice signal is standardized by the input units C3 and R11. The volume, quality and length of the sound are changed by the voice adjusting units R4, R4, C16 and become sound very similar with an original sound. 80% of the voice signals are a amplified by the echo IC 51, and the remaining 20% of the same are circulated and fed to the echo IC 51 and at the same time are converted into digital signals.

The converted digital signal passes through the resistor R7 in which the size and feed-back of the sound are adjusted. The digital signal is inputted into the echo IC 51 through a variable resistor 52, so that echo sound is generated. The generated echo sound is transferred to the voice amplification circuit 30 and is amplified to sound which can be outputted to the outside and is outputted through the speaker 2.

At this time, the echo sound by the mixer circuit 70 and the sound of the audio apparatus are concurrently outputted through the speaker 2.

INDUSTRIAL APPLICABILITY

In the present invention, a user's voice and an external sound from an audio apparatus can be outputted based on an echo effect when a user practices language or singing, so that it is possible to practice singing like a singing practice room, anytime. In addition, since an echo function is provided when a user practices language, it is possible to perform a language practice in a more actual situation. In addition, a user can sing pop songs while hearing a corresponding pop song through ears based on an echo effect, so that the user can practice pronunciation of a corresponding language like native speakers.

The invention claimed is:

1. In a remote controller for an audio apparatus which comprises a microphone driving unit (40) which operates in accordance with an operation of a main power switch (80) and drives a microphone (1) which receives a user's voice;

a microphone volume switch (42) which is connected with an output side of the microphone driving unit (40) for adjusting sound inputted from the microphone (1);

an input voice amplifier (30) which is connected with an output side of the microphone volume switch (42) and has a voice IC (31) for amplifying a voice signal inputted from the microphone (1);

a music volume switch (90) which adjusts an output sound inputted through an input plug of the audio apparatus connected with an output side of the input voice amplifier (30);

a voice mixer (70) which includes two resistors (R2) and (R3) between the input plug (11) and a speaker (2) and allows an output sound of the audio apparatus to impedance-match with respect to the speaker (2) and outputs a voice signal inputted through the microphone (1) and an output sound of the audio apparatus through different paths;

and a power amplifier (60) which amplifies current supplied from the power unit (61) in accordance with an operation of the main power switch (80), a remote controller having an echo function, comprising: an echo circuit (50) which includes an echo IC (51) and an echo volume switch (52), with the echo IC (51) being designed to amplify and circulate voice signals for generating echo, and with the echo circuit (50) being connected with the microphone driving unit (40), the voice amplifier (30) and the mixer circuit (70), respectively.

2. The remote controller of claim 1, wherein said remote controller is provided in an earphone or a head set.

3. The remote controller of claim 1, wherein said remote controller provided in an interior of an intermediate or large size head set.

4. The remote controller of claim 1, wherein said remote controller is provided in at least one among a CD player, a MP3, a cellular phone, and a DMB.

* * * * *